US006651404B1

(12) United States Patent
Hertfelder

(10) Patent No.: US 6,651,404 B1
(45) Date of Patent: Nov. 25, 2003

(54) PACKAGING MACHINE WITH A MACHINE STAND AND AN INSULATING HOUSING SEALINGLY CONNECTED TO THE MACHINE STAND

(75) Inventor: Thomas Hertfelder, Frankenhardt (DE)

(73) Assignee: Robert Bosch GmbH, Stuttgart (DE)

( * ) Notice: Subject to any disclaimer, the term of this patent is extended or adjusted under 35 U.S.C. 154(b) by 63 days.

(21) Appl. No.: 09/672,086

(22) Filed: Sep. 29, 2000

(30) Foreign Application Priority Data

Oct. 5, 1999 (DE) ..... 199 47 786

(51) Int. Cl.[7] ..... B65B 17/00
(52) U.S. Cl. ..... 53/167; 53/426; 53/461
(58) Field of Search ..... 53/167, 426, 461, 53/284.7, 469

(56) References Cited

U.S. PATENT DOCUMENTS 4,730,435 A * 3/1988 Riddle et al. ..... 53/167
4,803,827 A * 2/1989 Posey et al. ..... 53/167
5,007,232 A * 4/1991 Caudill ..... 141/63
5,117,587 A * 6/1992 Doan ..... 49/383
5,749,203 A * 5/1998 McGowan, Jr. ..... 53/432
5,878,553 A * 3/1999 Schlosser ..... 198/579
5,881,535 A * 3/1999 Gliniecki et al. ..... 53/133.2
6,125,613 A * 10/2000 Eberhardt et al. ..... 53/432
6,141,940 A * 11/2000 Bombe ..... 53/167

FOREIGN PATENT DOCUMENTS

DE 33 37 218 A1 4/1985
EP 0 903 297 A1 3/1999

* cited by examiner

*Primary Examiner*—Rinaldi I. Rada
*Assistant Examiner*—Louis Tran
(74) *Attorney, Agent, or Firm*—Ronald E. Greigg

(57) ABSTRACT

A packaging machine comprising a machine stand and an insulator housing sealingly connected to the machine stand. The connection to the machine stand is made via retainers, disposed on the machine housing, with a profile frame of the insulator housing resting on the retainers. Between the insulator housing and the machine stand, a gap is formed, in which a sealing element is disposed. The packaging machine according to the invention makes standardized machine stands possible, as well as a structure that is simpler from the production standpoint, because less stringent tolerances are required.

7 Claims, 5 Drawing Sheets

17
40
11
62
63
61
13
64
12
45
51

PACKAGING MACHINE WITH A MACHINE STAND AND AN INSULATING HOUSING SEALINGLY CONNECTED TO THE MACHINE STAND

BACKGROUND OF THE INVENTION

The invention relates to a packaging machine, in particular for filling and sealing containers containing liquid pharmaceuticals. A packaging machine of this kind has a hoodlike insulator housing, which sealingly surrounds a machine plate of a machine stand, thus forming a sterile chamber in which the containers are filled with a product and then sealed. On its underside toward the machine stand, the insulator housing has an encompassing, inward-drawn edge, which with the interposition of a sealing element, such as silicone, rests with its full surface on the top side of the machine plate, on the peripheral regions thereof. To fix the insulator housing on the machine stand, threaded bolts are also disposed on the underside of the inward-drawn edge of the insulator housing; the bolts engage suitably disposed openings in the machine plate. A disadvantage of this is that the machine stand with its machine plate is also used in packaging machines that lack the insulator housing, so that for those applications the machine plate is unnecessarily wide, considering that for reasons of standardization it is always desirable to use the same machine plate. The openings for the threaded bolts of the insulator housing furthermore require additional production effort and expense. Especially if the machine plate has a plurality of regions of different heights, the production of the insulator housing and of the machine plate is also relatively complicated, since the height tolerances of the components must be relatively tight in order to limit the heights of the gaps.

ADVANTAGES OF THE INVENTION

The packaging machine according to the invention, particularly for filling and sealing containers containing liquid pharmaceuticals has an advantage that the production effort and expense for both the machine plate and the insulator housing are reduced, since the tolerances for the individual components can be less stringent. Furthermore, both for filling systems that use an insulator housing and filling systems without an insulator, one and the same relatively narrow machine plate can be used. Disposing the insulator housing according to the invention also makes monitoring simpler and enables easier replacement of the sealing element, since there is no longer any need to dismantle or remove the insulator housing.

The invention will be better understood and further objects and advantages thereof will become more apparent from the ensuing detailed description of preferred embodiments taken in conjunction with the drawing.

DESCRIPTION OF THE PREFERRED EMBODIMENTS

Figures 1, 2:
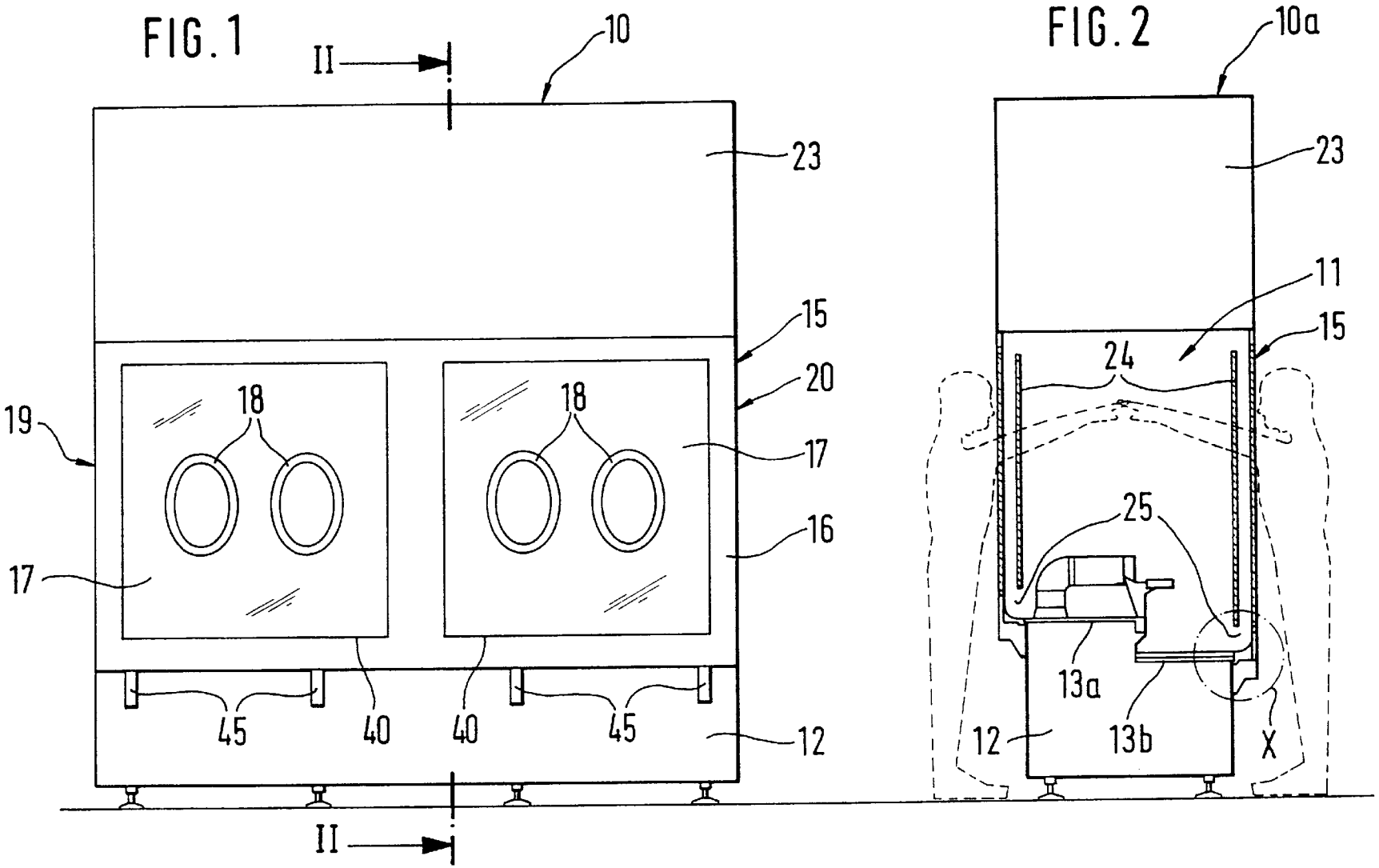
FIG. 1 is simplified side view of a packaging machine according to the invention for filling and sealing containers.
FIG. 2 is a section taken along the line II—II of FIG. 1.

The packaging machine 10 shown in the drawings is used in the pharmaceutical industry for filling and sealing containers, such as ampules, vials or the like. The packaging machine 10 is constructed by the so-called insulator technique; that means that sterile conditions prevail in the interior 11 of the packaging machine 10. To that end, the packaging machine 10 has a machine stand 12, in which the essential drive components are disposed. The top of the machine stand 12 is closed off by at least one machine plate 13, and in the exemplary embodiment shown two machine plates 13*a*, 13*b*, which are disposed at different levels (see FIG. 2). Located in the region above the one machine plate 13*a* are filling and sealing devices for the containers, while a transport device for the containers is located in the region above the machine plate 13*b*.

The interior 11 is defined by the machine plate 13 on one side and by an insulator housing 15 sealingly surrounding the plate 13. The hoodlike insulator housing 15 has side walls 16, in which inspection windows 17 are inserted. Inserts 18 for rubber gloves, for instance, are also disposed in the inspection windows 17, so that manipulation can be done by hand in the interior 11. Locks, not shown, are also embodied on the face ends 19, 20 of the insulator housing 15, so that the containers can be introduced into the interior 11 and shunted out of the housing.

To prevent unsterile air from entering the interior 11 through the aforementioned locks and to develop a well-aimed air course with as laminar an air flow as possible inside the interior 11, a blower or recirculating system is used, which is disposed in a chestlike region 23 in the upper part of the insulator housing 15. A recirculating fan, for instance, is located in this region 23 along with sterile air filters, which clean the air aspirated from the interior 11 and carry the air in a well-aimed way back into the interior in terms of their flow direction and flow speed. The aspiration of the air from the interior 11 preferably takes place in the peripheral regions of the insulator housing 15, and the inspection windows 17 are therefore embodied as double-paned windows with inner panes 24. The inner panes 24 extend to just above the machine plate 13, so that the air is aspirated via the peripheral gaps 25.

Figure 3:
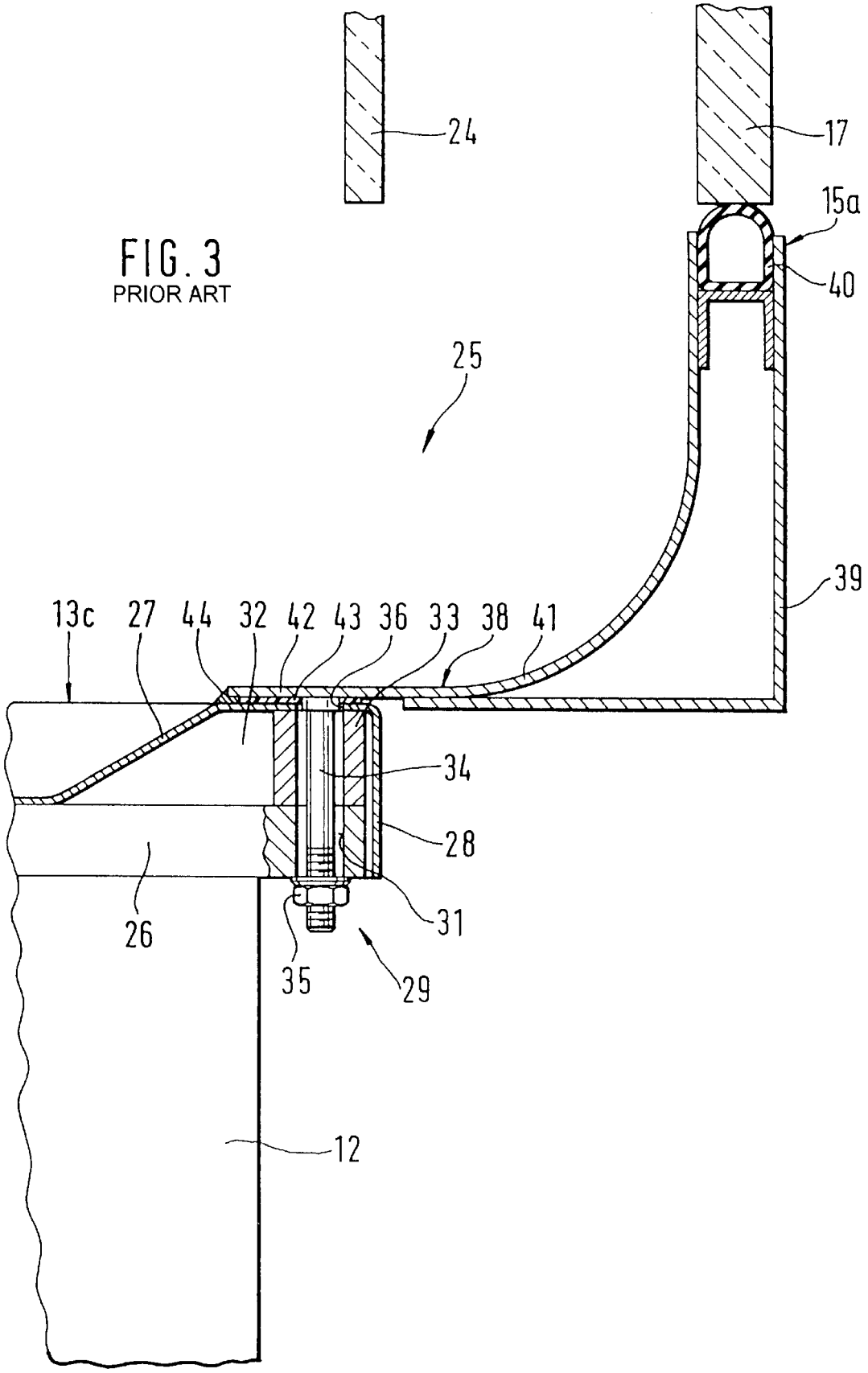
FIG. 3 PRIOR ART
FIG. 3 is a section in the region of the insulator housing fastening and the inspection window in the prior art.

In order also to prevent unsterile air from reaching the interior 11 via the point of contact between the machine plate 13 and the insulator housing 15, it is necessary for the insulator housing 15 to be sealed off from the machine plate 13. With respect to the prior art, FIG. 3 will now be described in this respect: It can be seen here that the machine plate 13*c* comprises a solid base plate 26 and a sheet-metal cover plate 27 that covers the base plate 26. The cover plate 27 has an edge 28 bent at an angle, and this edge laterally covers the circumference of the base plate 26. A through bore 31 is formed in a region 29 of the base plate 26 that protrudes laterally past the machine stand 12. A spacer sleeve 33 aligned with the through bore 31 is also disposed in an interstice 32 between the base plate 26 and the cover plate 27. A threaded bolt 34 is disposed inside the spacer sleeve 33 and the through bore 31, and the threaded bolt 34 penetrates the cover plate 27 in the region of a hole 36 and cooperates with a nut 35. The threaded bolt 34 is fastened or welded to a sheet-metal profile frame 38. The profile frame 38 is embodied as a closed frame or chest 39, which receives the inspection windows 17 with the interposition of inflatable molded seals 40. A curved wall 41 of the chest 39 extends in a straight line, on the side toward the machine plate 13, in a peripheral zone 42, which covers the cover plate 27 to approximately the height of the machine stand 12, and the threaded bolt 34 is secured to its underside. A sealing element, for instance in the form of a sealing band 43, is also disposed between the peripheral zone 42 and the cover plate 27, and this sealing band is adjoined, on the side toward the interior 11, by a silicone bead 44 serving as a termination.

Figure 4:
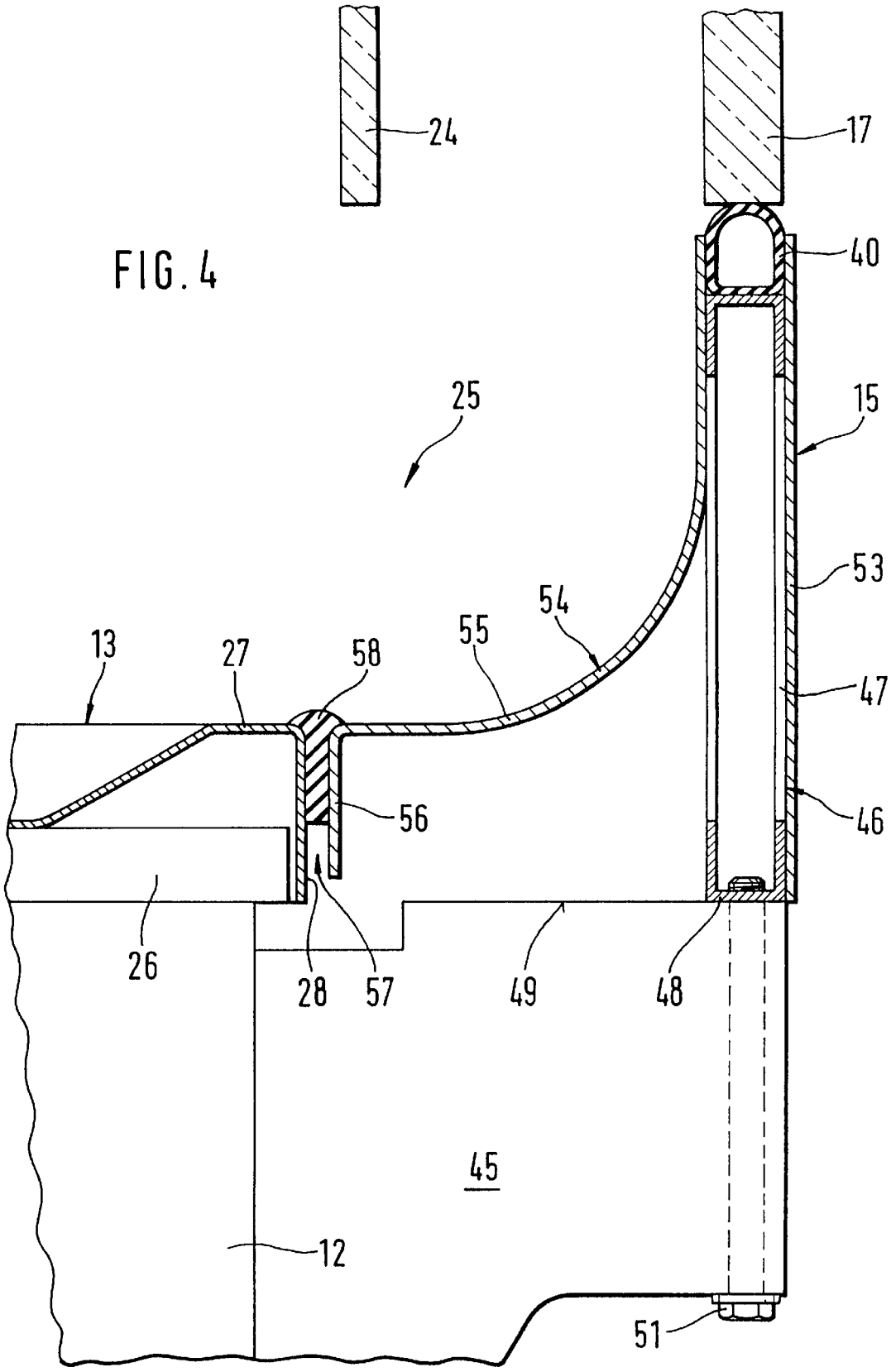
FIG. 4 shows a first insulator fastening according to the invention in terms of the detail marked X in FIG. 2.

A first coupling according to the invention of the insulator housing 15 to the machine stand 12 will now be is described in conjunction with FIG. 4: The machine plate 13 used here, in contrast to the machine plate 13*c* of the prior art, protrudes laterally only somewhat past the machine stand 12, and this is predominantly for reasons of appearance. A plurality of retainers 45 are disposed laterally on the machine stand 12. These retainers 45 serve as a bearing face and capability of fastening the insulator housing 15 to a profile frame 46. The profile frame 46 has a basic profile 47 of rectangular cross section, which with its short side 48 rests on the top side 49 of the carriers 45 and is fastened replaceably to the carriers 45 in some suitable way, for instance by means of screw connections 51. The basic profile 47 is defined laterally at least in part by two molded metal sheets 53, 54, which on the side remote from the carriers 45, together with the molded seal 40 make it possible to receive the side wall 16 in a tight and positive way. The molded metal sheet 54 oriented toward the machine plate 13 has a curvature 55 which comes to an end at the level of the top of the cover plate 27, as well as a bent portion 56 disposed at least substantially parallel to the edge 28 of the cover plate 27. The spacing between the portion 56 and the edge 28 of the cover plate 27 is approximately 3–10 mm; the gap 57 thus formed has a length such that a sealing element 58 can be disposed in the gap 57. In the first exemplary embodiment of the invention shown in FIG. 4, this sealing element 58 is in one piece, for example being embodied as a molded seal or as an inflatable sealing element 58.

Figure 5:
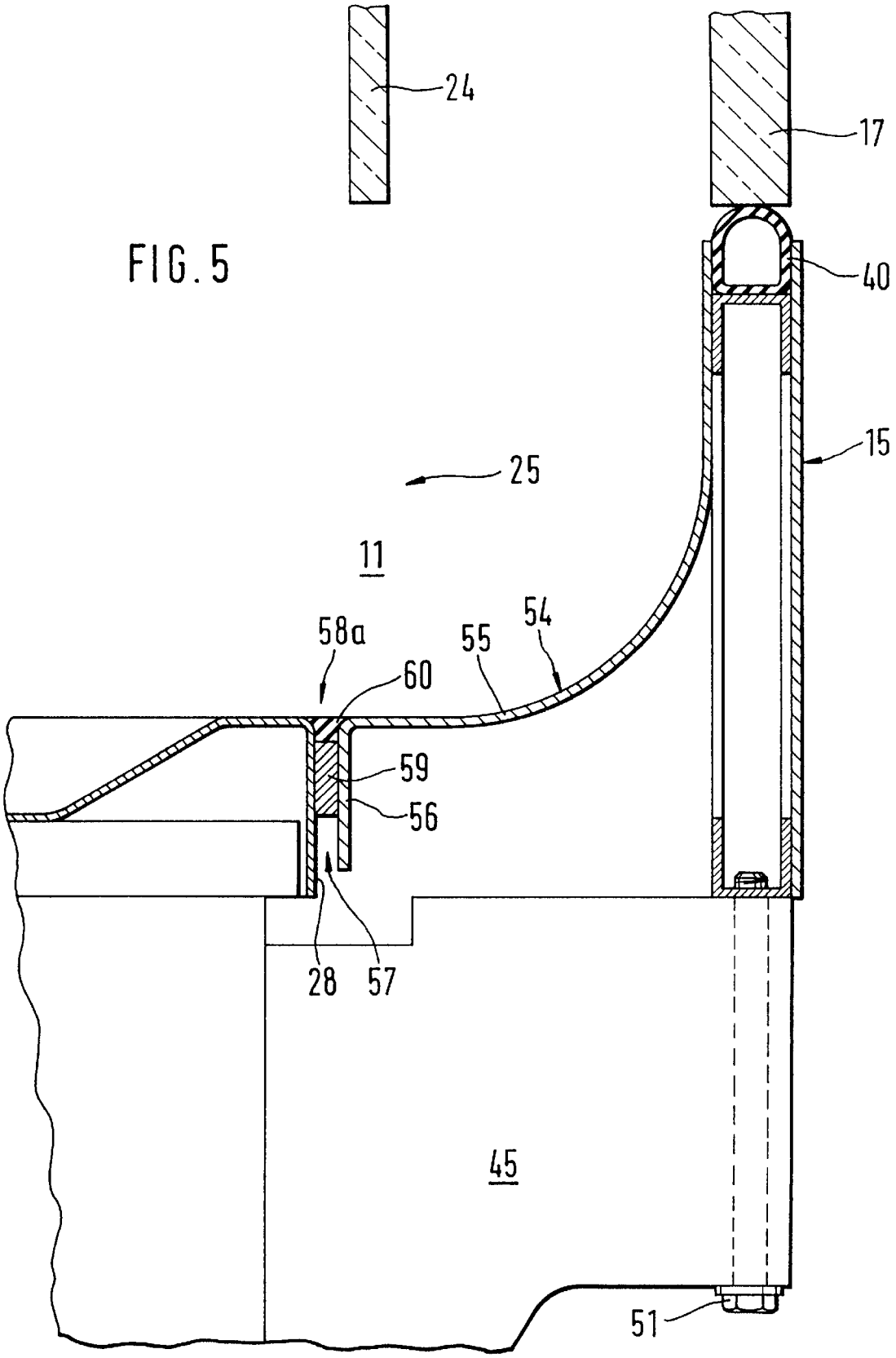
FIG. 5 shows a second insulator fastening according to the invention.

The second exemplary embodiment shown in FIG. 5 differs from the first exemplary embodiment of FIG. 4 in its sealing element 58*a*, which now comprises two pieces: a sealing band 59, and a silicone bead 60. The sealing band 59 is located in the gap 57, while the silicone bead 60 makes a smooth transition possible between the cover plate 27 and the molded metal sheet 55 toward the insulator housing 11.

Figure 6:
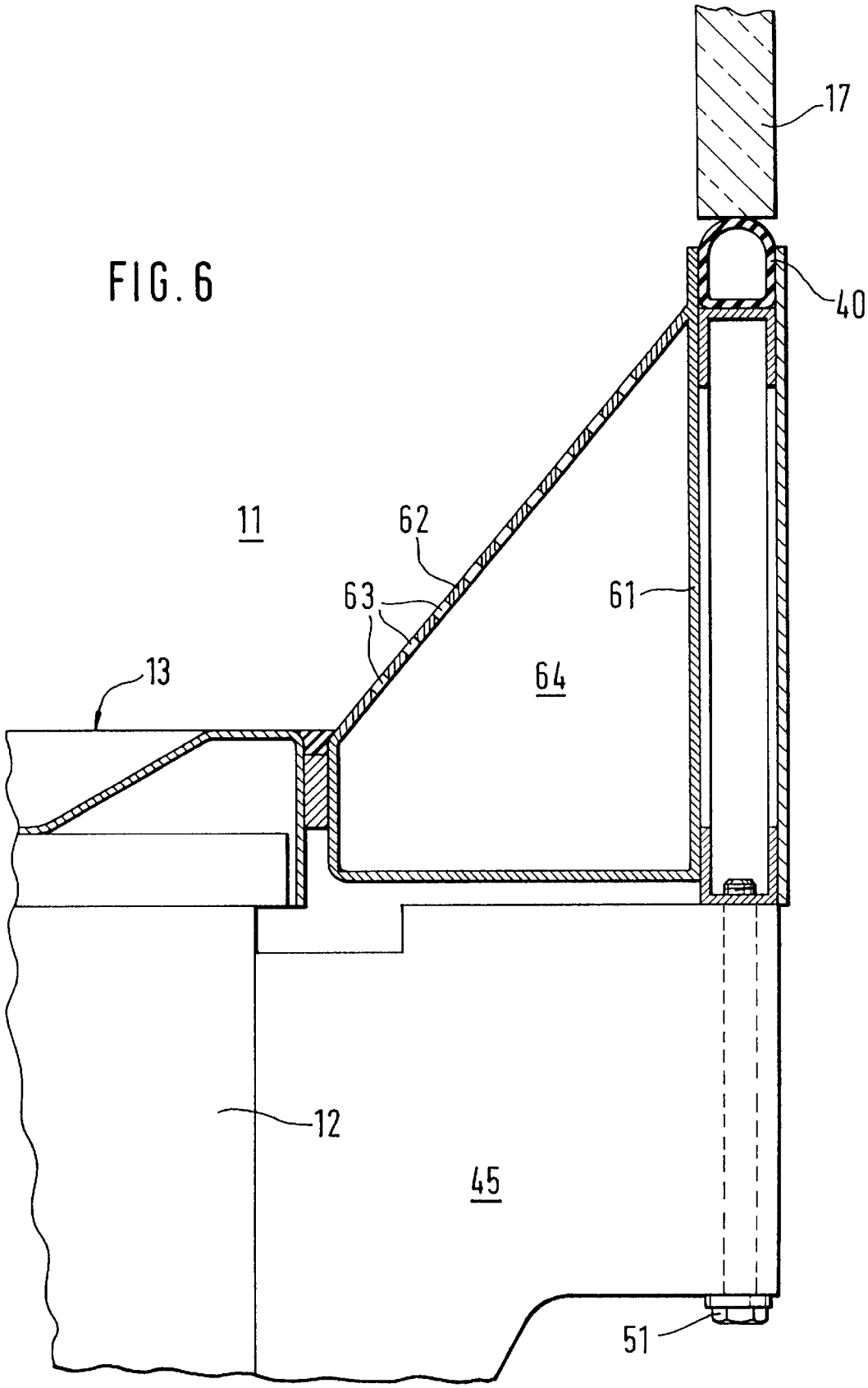
FIG. 6 shows a third insulator fastening according to the invention.

The third exemplary embodiment of the invention, shown in FIG. 6, differs from the first two exemplary embodiments of the invention in dispensing with an inner plate 24, between which and the side wall 16 the aspiration of air otherwise takes place. In FIG. 6, the profile frame 61 is embodied as a chest of closed cross section, which on the side toward the interior 11 has an oblique boundary wall 62 with aspiration bores 63. The profile frame 61, or the aspiration conduit 64 formed by the profile frame, communicates with a negative-pressure source, not shown, which makes it possible to aspirate air out of the interior 11 through the aspiration bores 63.

It will additionally be noted that the retainers 45 can also be installed even with machine stands 12 that are not coupled to an insulator housing 15. In that case, the retainers 45 can serve as a means of securing a lining or the like.

The foregoing relates to preferred exemplary embodiments of the invention, it being understood that other variants and embodiments thereof are possible within the spirit and scope of the invention, the latter being defined by the appended claims.

I claim:

1. A packaging machine (10) for filling and sealing containers containing liquid pharmaceuticals, comprising a machine stand (12) having at least one cover plate (13; 13*a*; 13*b*), an insulator housing (15), which is connected to the at least one cover plate (13; 13*a*; 13*b*) with an interposition of a sealing element (58; 58*a*, 59, 60), so that a sterile interior (11) is formed by the insulator housing (15) and the at least one cover plate (13; 13*a*; 13*b*), the at least one cover plate (13; 13*a*; 13*b*) having an underside toward the machine stand, a top side toward the insulator housing (15), and an outer edge portion extending substantially the length of the cover plate (28) that protrudes laterally past the machine stand (12) and disposed at an angle to the top side, the insulator housing (15) laterally surrounds the at least one cover plate (13; 13*a*; 13*b*), and the sealing element (58; 58*a*, 59, 60) is disposed substantially in a gap (57) between the edge portion (28) of the at least one cover plate (13; 13*a*; 13*b*) and the insulator housing (15).

2. The packaging machine according to claim 1, in which the insulator housing (15), on a side toward the edge portion (28) of the at least one cover plate (13; 13*a*; 13*b*), has a wall portion (56) which extends substantially parallel to the edge portion (28), so that between the edge portion (28) and the wall portion (56), the gap (57) for the sealing element (58; 58*a*, 59, 60) is formed.

3. The packaging machine according to claim 1, in which retaining elements (45) that laterally protrude past the edge portion (28) are disposed on the machine stand (12), and the insulator housing (15) is fastened to the retaining elements.

4. The packaging machine according to claim 2, in which retaining elements (45) that laterally protrude past the edge portion (28) are disposed on the machine stand (12), and the insulator housing (15) is fastened to the retaining elements.

5. The packaging machine according to claim 3, in which the insulator housing (15) rests on a top side (49) of the retaining elements (45).

6. The packaging machine according to claim 4, in which the insulator housing (15) rests on a top side (49) of the retaining elements (45).

7. The packaging machine according to claim 1, in which the insulator housing (15) has a profile frame (61) with a boundary wall (62) that has aspiration bores (63), through which the air can be aspirated out of the sterile interior (11) just above the at least one cover plate (13).

* * * * *